US010012017B2

(12) United States Patent
Angebault et al.

(10) Patent No.: US 10,012,017 B2
(45) Date of Patent: Jul. 3, 2018

(54) SYSTEM FOR SLIDING A DOOR

(71) Applicant: Etablissements Sogal Fabrication, La Jumelliere (FR)

(72) Inventors: Joel Angebault, La Jumelliere (FR); Laurent Dile, La Jumelliere (FR)

(73) Assignee: ETABLISSEMENTS SOGAL FABRICATION, La Jumelliere (FR)

( * ) Notice: Subject to any disclaimer, the term of this patent is extended or adjusted under 35 U.S.C. 154(b) by 0 days.

(21) Appl. No.: 15/024,982

(22) PCT Filed: Aug. 26, 2014

(86) PCT No.: PCT/FR2014/052127

§ 371 (c)(1),
(2) Date: May 13, 2016

(87) PCT Pub. No.: WO2015/028751

PCT Pub. Date: Mar. 5, 2015

(65) Prior Publication Data

US 2016/0265259 A1 Sep. 15, 2016

(30) Foreign Application Priority Data

Aug. 27, 2013 (FR) ..... 13 58219

(51) Int. Cl.

| | |
|---|---|
| ***E05D 15/08*** | (2006.01) |
| ***E05D 15/06*** | (2006.01) |
| ***E05F 15/643*** | (2015.01) |

(52) U.S. Cl.

CPC ..... *E05D 15/08* (2013.01); *E05D 15/0686* (2013.01); *E05F 15/643* (2015.01); *E05Y 2900/20* (2013.01)

(58) Field of Classification Search

CPC .... E05D 15/0686; E05D 15/08; E05F 15/643; E05Y 2900/20

See application file for complete search history.

(56) References Cited

U.S. PATENT DOCUMENTS

| | | | | |
|---|---|---|---|---|
| 1,849,371 A | | 3/1932 | Gronbech | |
| 3,890,744 A | * | 6/1975 | Galis | E05F 15/643 49/139 |

(Continued)

FOREIGN PATENT DOCUMENTS

| | | |
|---|---|---|
| CN | 102733718 A | 10/2012 |
| DE | 10235671 A | 2/2004 |

(Continued)

OTHER PUBLICATIONS

International Search Report dated Jan. 23, 2015, for International Patent Application No. PCT/FR2014/052127.

(Continued)

*Primary Examiner* — Gregory J Strimbu
(74) *Attorney, Agent, or Firm* — Karceski IP Law, PLLC

(57) ABSTRACT

A system for sliding a door of, for example, a cupboard, includes a bottom slide rail suitable for being set on a surface such that the door can come to bear on the bottom slide rail. A connecting device slides in the bottom slide rail. This connecting device is secured to a bottom of the door. A drive device exerts a drive force on the connecting device to cause the connecting device to slide in the bottom slide rail.

12 Claims, 8 Drawing Sheets

(56) References Cited

U.S. PATENT DOCUMENTS

| | | | | |
|---|---|---|---|---|
| 4,893,435 | A * | 1/1990 | Shalit | E05F 15/643 49/139 |
| 5,203,116 | A * | 4/1993 | Chen | E05D 15/0621 16/95 R |
| 5,755,060 | A * | 5/1998 | Zweili | E05B 65/0829 49/322 |
| 2010/0031574 | A1* | 2/2010 | Hormann | E05F 15/681 49/199 |
| 2010/0269412 | A1* | 10/2010 | Mellary | B60J 1/1853 49/130 |
| 2013/0212948 | A1* | 8/2013 | Nixon | E05F 15/10 49/349 |
| 2015/0033633 | A1* | 2/2015 | Tarrega Lloret | E05D 15/0656 49/406 |
| 2015/0121764 | A1* | 5/2015 | Lee | E05D 15/0665 49/420 |
| 2016/0194910 | A1* | 7/2016 | Pellegrini | E05D 15/1081 49/362 |

FOREIGN PATENT DOCUMENTS

| | | | |
|---|---|---|---|
| DE | 102010016040 | A1 | 8/2011 |
| WO | WO 95/02105 | | 1/1995 |
| WO | WO 9964709 | | 12/1999 |

OTHER PUBLICATIONS

International Preliminary Report on Patenability dated Jan. 21, 2016, for International Patent Application No. PCT/FR2014/052127.

* cited by examiner

SYSTEM FOR SLIDING A DOOR

CROSS-REFERENCE TO RELATED APPLICATIONS

This is a National Stage Entry into the United States Patent and Trademark Office from International PCT Patent Application No. PCT/FR2014/052127, having an international filing date of Aug. 26, 2014, which claims priority to French Patent Application No. 1358219, filed Aug. 27, 2013, the entire contents of both of which are incorporated herein by reference.

TECHNICAL FIELD

One aspect of the invention relates to a system for sliding a door in an automated manner. The door can be, for example, a cupboard door. One embodiment of the system can slide several doors along several parallel sliding axes. Another aspect of the invention relates to a cupboard.

PRIOR ART

A cupboard may comprise one or more doors which move by sliding. The doors are typically held between a bottom slide rail and a top slide rail. These slide rails comprise one or more slide tracks opposite each other. A slide track can accommodate one or more mechanisms with casters attached to a door. The door can therefore slide along the slide track, which forms a guide.

A door can be moved manually by sliding. However, manual operation of a sliding door has disadvantages. A user must exert a certain force to move the door by sliding. This force may be relatively large to start this movement. The user may then need to exert a force to slow down and stop the door. A damper system may be provided to slow down and stop a door at the end of its movement. However, this type of damper system may introduce an additional resistance, which increases the force required to move a door by sliding.

Furthermore, for typically aesthetic reasons, a door may have a design which makes the door difficult to grip. This introduces a difficulty to exert the force required to slide the door. People with reduced physical capacities, such as the disabled, the elderly, or children, will find it difficult to move a door by sliding, for example to access a storage space. These people may even be unable to move the door. Whatever the case, manual operation of a sliding door may be a source of discomfort.

In addition, manual operation of a sliding door typically requires at least one free hand. However, a user can be in front of the door with both hands holding one or more items to store. In this case, the user must put down the object(s) somewhere in order to slide the door. The user must then pick up the object(s) in order to store them. This is also a factor of discomfort and fatigue.

In addition, manual operation of a door creates a risk of injury. For example, a finger may be pinched or even crushed between a door and a static wall, or another door. There is also a risk of shearing feet at the bottom.

One or more disadvantages identified in the preceding paragraphs are amplified in an embodiment where a storage space can be accessed by several sliding doors, which move in several slide tracks. In this type of embodiment, accessing different sections of the storage space, for example left and right, involves moving several doors. This amplifies the fatigue factor as well as the risk of injury. Fingers may be caught and sheared when front and rear doors cross each other.

Manual operation of a sliding door may also affect the aesthetics of the door. A hand on the door may leave marks on the door, which are especially visible when, for example, the door is lacquered or comprises a glass front.

Motorized operation of a sliding door may overcome one or more of the disadvantages identified above. To do this, a motorized top slide rail may be provided. This slide rail will typically be fixed to a ceiling defining a storage space at the top.

The patent publication CN102733718 describes an electrical drive mechanism for sliding two doors. This mechanism comprises a double layer top rail, containing a motor with a wheel driving a belt.

The patent publication DE 102 35 671 describes a guide for large, heavy doors intended to close the entrances of a hall, such as an aircraft hangar, having an entrance pavement. This guide supports the weight of such a door so that a roof of the hall is not overloaded. The guide comprises a guide rail which is attached to a support in a free space below the level of the entrance pavement. Rollers are arranged in the guide rail. These rollers are connected to the door by means of a support element which, from the rollers, first extends downwards then sideways then upwards, through a longitudinal slot in the entrance pavement.

DESCRIPTION OF THE INVENTION

There is a need for a solution to install relatively easily a system for sliding a door, in numerous different applications.

In this respect, the following points were taken into consideration. A system comprising a motorized top slide rail, for sliding a door in an automated manner, can be difficult to install. A motorized top slide rail is generally heavy. Consequently, this type of rail must be attached to a relatively rigid wall. However, a storage space to which the system is applied can be defined at the top by a wall which is relatively flexible, typically a false ceiling. In this type of embodiment, it will be necessary to provide relatively complex attachments, which pass through the false ceiling, to attach the top slide rail to a rigid wall, a "real" ceiling, located behind the false ceiling.

In addition, an environment in which a system for sliding a door is applied generally has geometrical and dimensional imperfections. This type of environment typically comprises walls which will not be perfectly perpendicular, parallel, or which are not perfectly aligned. In addition, there are typically differences between dimensions which are supposed to be identical. Consequently, there are geometrical and dimensional deviations which must be taken into account. These deviations are advantageously compensated during an installation. To do this, the system may advantageously be designed to allow such compensation, for example, by making adjustments. However, this type of compensation arrangement may prove complex, especially concerning the adjustments to be made, when the system comprises a motorized top slide rail.

According to one aspect of the invention, a system for sliding a door provided with rolling mechanisms, is characterized in that the system comprises:

- a bottom slide rail consisting of a unit adapted to be placed on the ground and having:
  - a top side with a longitudinal slot,
  - an inner wall arranged parallel to the top side so that the unit comprises, firstly, a slide channel between the longitudinal slot in the top side of the unit and the inner wall of the unit and, secondly, a bottom compartment, the inner wall being adapted to form a bearing surface for casters of the door rolling mechanisms, a connecting lug attachable to a bottom part of the door, the connecting lug being able to slide in the longitudinal slot, and a drive device adapted to exert a driving force on the connecting lug in order to slide the connecting lug in the longitudinal slot, the drive device comprising a transmission arrangement adapted to convert a rotational movement of a motor drive shaft into a linear movement of the connecting lug, the transmission arrangement being at least partially arranged in the bottom compartment.

In this type of system, a door is caused to slide by the bottom slide rail. This bottom rail is typically relatively heavy and, in addition, the bottom rail supports the weight of one or more doors. During an installation, the bottom rail simply has to be placed on the ground and then prevented from moving. In one embodiment, the distance between two side walls may prevent longitudinal movement of the bottom rail. The bottom rail can also be attached relatively easily to a wall next to a part of the bottom rail. This attachment can be relatively easy, since the attachment simply has to prevent the bottom rail from moving on the ground.

A top slide rail can be relatively light and can therefore simply be attached to a relatively flexible wall, such as a false ceiling. There is no need to provide relatively complex attachments through the false ceiling to reach a "real" ceiling. In addition, a system according to the invention can relatively easily compensate for the geometrical and dimensional deviations in an environment where the system is installed.

In addition, the system is compatible with existing conventional doors, equipped with casters. There is no need to design doors especially adapted to the system. The system can therefore be manufactured and implemented at relatively low costs. The system has only a relatively modest additional manufacturing cost compared with conventional, non-motorized systems.

During an installation, a door can simply be placed on the bottom slide rail by inserting the door casters in the longitudinal slot above the slide track. The casters press against the inner wall like casters pressing on the bottom of a conventional, non-motorized slide rail. Positioning of the door, as well as the verticality adjustments, may be identical to those of a cupboard door in a conventional, non-motorized sliding system. In addition, the connecting lug simply has to be attached to the door, which can also be released relatively quickly and easily.

A system according to the invention may therefore be installed and removed relatively quickly and easily. In addition, a system according to the invention allows easy and safe use by overcoming one or more disadvantages, described above, of a manual system.

A system according to the invention is particularly suitable for making cupboards. The bottom slide rail can be flush with a cupboard floor, which is generally above the ground. Thus, the bottom slide rail does not form an inconvenient threshold. Visually, this bottom rail forms an extension of the floor. In addition, the bottom slide rail can form a protective and safety threshold against possible shear contacts between the bottom of a door and a user's foot or toe.

Another aspect of the invention therefore relates to a cupboard comprising a system as defined above.

One embodiment of the invention advantageously comprises one or more of the following additional characteristics, which are described in the following paragraphs.

The transmission arrangement may comprise a looped belt of which a segment is attached to the connecting lug. A pair of pulleys can then hold the looped belt. The pair of pulleys can be connected to the inner wall of the unit, so that the belt passes through the slide channel and the bottom compartment of the unit.

The looped belt can consist of a continuous belt. In this case, the pulley connected to the motor can be toothed.

The looped belt may consist of a belt having two ends with one connected to the other by a connecting device.

The connecting device may be located in the bottom compartment of the unit.

The motor can be arranged outside the unit.

The unit may comprise an assembly of several profiles: a lower U-shaped profile and a main upper profile that can cover the lower profile. In this case, the upper profile may comprise the inner wall and a pair of longitudinal edge segments protruding from the inner wall. The assembly may further comprise a complementary upper profile attachable to the main upper profile between the pair of longitudinal edge segments.

An edge segment may have a hollow interior defined by a set of walls: an outer side wall protruding from the inner wall, an inner side wall protruding from the inner wall, and a covering wall extending between the outer side wall and the inner side wall.

The complementary upper profile may comprise a hollow interior defined by a set of walls: a base wall, a pair of side walls protruding from the base wall, and a covering wall extending between the pair of side walls.

At least one of the following walls may have the shape of a half-vault: the inner side wall of the edge segment and the pair of side walls of the complementary upper profile.

The profiles can be attached to each other by screwing.

As an illustration, a detailed description of some embodiments of the invention is provided below with reference to accompanying drawings.

DETAILED DESCRIPTION

Figure 1:
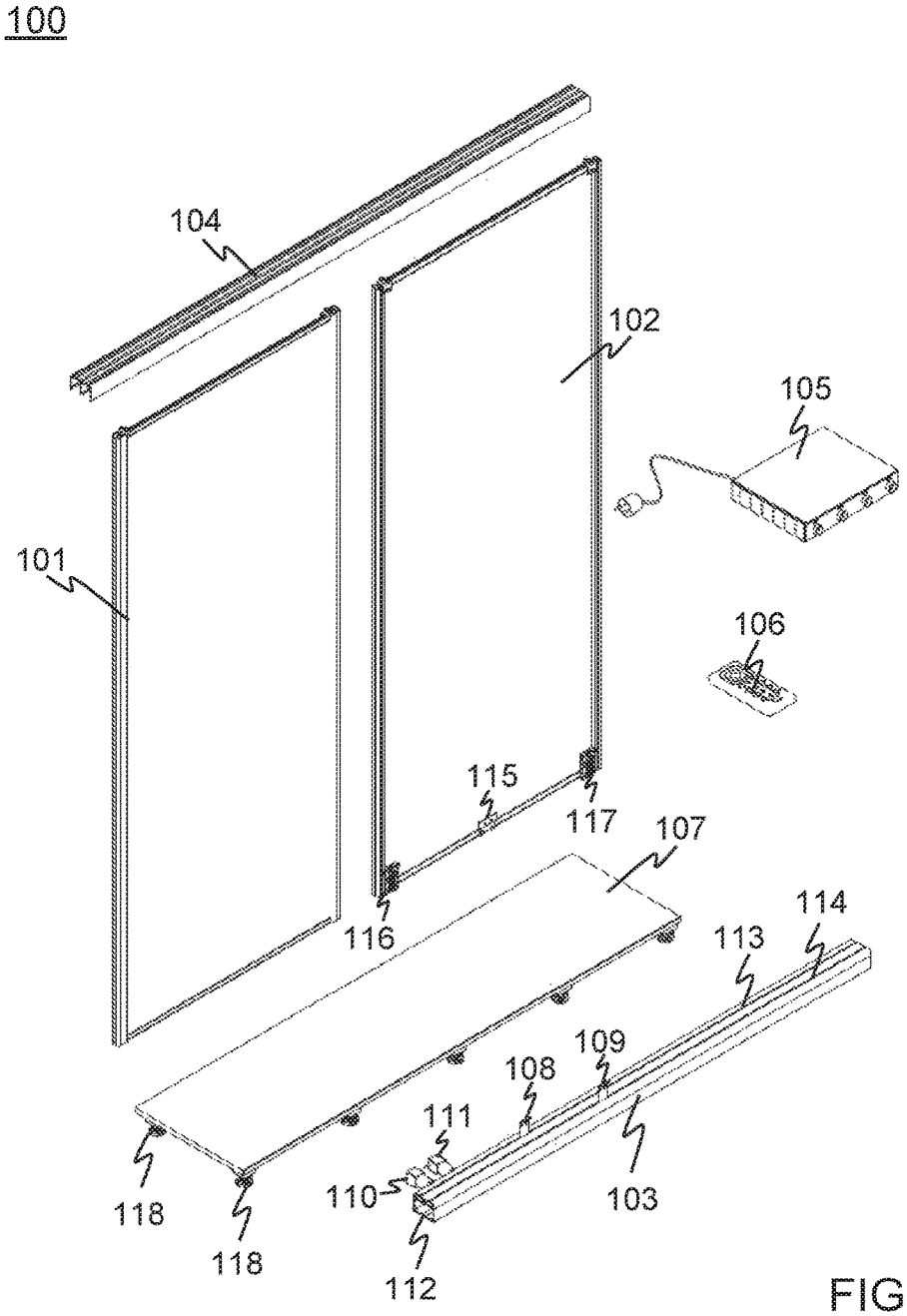
FIG. 1 is a diagrammatic representation of a system for sliding two doors, showing a perspective and exploded view.

FIG. 1 is a diagrammatic representation of a system 100 for sliding two doors: a first door 101 and a second door 102. FIG. 1 shows a diagrammatic perspective and exploded view of the system 100. The system 100 comprises a bottom slide rail 103, a top slide rail 104, a control unit 105, and a remote control 106. FIG. 1 also illustrates a floor 107, which can be added to the system 100.

During an installation, the bottom slide rail 103 is placed on the ground. The floor 107 is also placed on the ground and advantageously flush with the bottom slide rail 103. The two doors 101, 102 rest on the bottom slide rail 103. The top slide rail 104 accommodates an upper part of each of the two doors 101, 102.

Two connecting devices 108, 109 can slide in the bottom slide rail 103. A first connecting device 108 can slide along a first sliding axis. A second connecting device 109 can slide along a second sliding axis which is parallel to the first sliding axis. The first connecting device 108 is attachable to a bottom part of the first door 101. Similarly, the second connecting device 109 is attachable to a bottom part of the second door 102.

The bottom slide rail 103 is provided with two motors: a first motor 110 and a second motor 111. These motors are respectively part of a first drive device and a second drive device. The first drive device is adapted to exert a driving force on the first connecting device 108 in order to slide the first connecting device 108 in the bottom slide rail 103. Similarly, the second drive device is adapted to exert a driving force on the second connecting device 109 in order to slide the second connecting device 109 in the bottom slide rail 103. An embodiment of these drive devices will be described in more detail below.

More specifically, the first connecting device 108 consists of a lug. The same applies for the second connecting device 109. In the remainder of this document, these elements will be respectively designated as first connecting lug 108 and second connecting lug 109. The first drive device comprises a transmission arrangement which converts a rotational movement of a drive shaft of the first motor 110 into a linear movement of the first connecting lug 108. Similarly, the second drive device comprises a similar transmission arrangement. These transmission arrangements will be described in more detail below.

In more detail, the bottom slide rail 103 comprises a unit 112. The unit 112 has an top side with two longitudinal slots: a first longitudinal slot 113 and a second longitudinal slot 114. The first connecting lug 108 can slide in the first longitudinal slot 113. The second connecting lug 109 can slide in the second longitudinal slot 114. These longitudinal slots therefore define respectively the first sliding axis and the second sliding axis mentioned above. The transmission arrangement which enables the first motor 110 to slide the first connecting lug 108 is arranged in the unit 112. The same applies for the other transmission arrangement which enables the second motor 111 to slide the second connecting lug 109. This transmission arrangement is also arranged in the unit 112.

The top slide rail 104 may be passive, i.e. non-motorized. The top slide rail 104 does not have to bear the weight of the two doors 101, 102. The top slide rail 104 comprises two running tracks: a first running track and a second running track. An upper part of the first door 101 can slide in the first running track. Guides with casters mounted on bearings allow this sliding. Similarly, an upper part of the second door 102 can slide in the second running track using such guides.

The second door 102, shown from the back on FIG. 1, is provided with an attachment plate 115 on a lower part thereof, located on a lower edge of the second door 102. An upper part of the second connecting lug 109 can be attached to this attachment plate 115. This attachment can be made in different ways, for example by screwing. Thus, the second connecting lug 109 can be mechanically connected to the second door 102 and thereby slide this door.

The second door 102 is further provided with two rolling mechanisms 116, 117. These mechanisms may be of the "Robotwin" type, a trademark registered by the company SOGAL, France. This type of mechanism has been described in European patent EP 0707 681 filed by this company. The Robotwin mechanism comprises a caster mounted on ball bearings, and hooks to clip in the second longitudinal slot 114 of the bottom slide rail 103. This guides the second door 102 and prevents it from derailing. The Robotwin mechanism is removable, retractable and telescopic. Thus, the Robotwin mechanism allows height adjustments. The mechanism also allows possible verticality compensation with respect to the walls surrounding the system 100 illustrated on FIG. 1 during an installation.

The first door 101, shown from the front on FIG. 1, can also be provided with an attachment plate and two rolling mechanisms as described above. These elements are not visible on FIG. 1, since the first door 101 is shown from the front. The first door 101 can be identical to the second door 102, at least as regards the elements provided for sliding this door in the bottom slide rail 103 and the top slide rail 104.

The floor 107 comprises height-adjustable feet 118. A top side of the floor 107 is visible on FIG. 1. By adjusting the height of the feet 118, the top side can be moved to a level with respect to the ground which is identical, or at least very close to that of the top side of the unit 112 of the bottom slide rail 103, when the latter is placed on the ground. The floor 107 is therefore flush with the bottom slide rail 103.

The control unit 105 can be electrically connected to the two motors 110, 111 of the bottom slide rail 103. The control unit 105 can therefore apply actuation signals to the two motors 110, 111 in order to control them and, consequently, to control the sliding of the two connecting lugs 108, 109. In addition, the control unit 105 may optionally receive detection signals from the bottom slide rail 103, in particular from the two motors 110, 111. The control unit 105 comprises a lead with plug to be plugged into the mains electricity supply.

The remote control 106 can send control signals to the control unit 105. The control unit 105 controls the two motors 110, 111 according to the control signals received from the remote control 106. Thus, the remote control 106 allows a user to control the sliding of the two connecting lugs 108, 109 and thus control the sliding of the two doors 101, 102.

However, the remote control 106 is optional: a user can slide the two doors 101, 102 in an automated manner without using the remote control 106. The user can give a slight push to a door, the first 101 or the second 102 in one of the two following directions: opening or closing. The control unit 105 detects this initial push and, in response, continues to slide the door in the direction of the initial push, up to a predefined stopping point. This feature will be described in more detail below.

Figure 2:
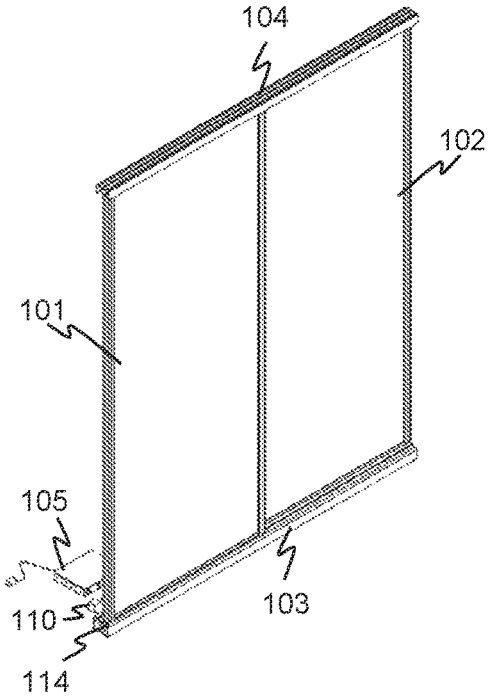
FIG. 2 is a diagrammatic representation of the system in a partially assembled state, showing a front and perspective view.
Figure 3:
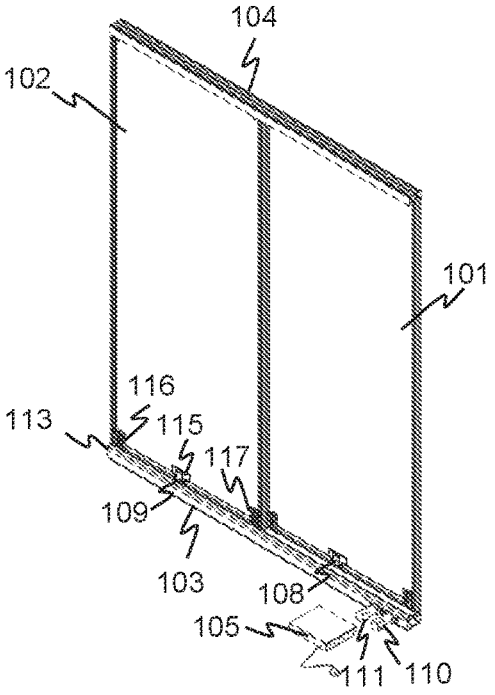
FIG. 3 is a diagrammatic representation of the system in the partially assembled state, showing a rear and perspective view.

FIGS. 2 and 3 are diagrammatic representations of the system 100 in a partially assembled state. FIG. 2 shows a front perspective view of the system in this state. FIG. 3 shows a rear perspective view.

The two doors 101, 102 are held between the bottom slide rail 103 and the top slide rail. The two rolling mechanisms of the first door 101 are held in the first longitudinal slot 113 of the bottom slide rail 103. The two rolling mechanisms 116, 117 of the second door 102, also visible on FIG. 1, are held in the second longitudinal slot 114 of the bottom slide rail 103. The first door 101 is attached to the first connecting lug 108 of the bottom slide rail 103 by means of the attachment plate fitted to this door. Similarly, the second door 102 is attached to the second connecting lug 109 of the bottom slide rail 103 by means of the attachment plate fitted to this door.

Figure 4:
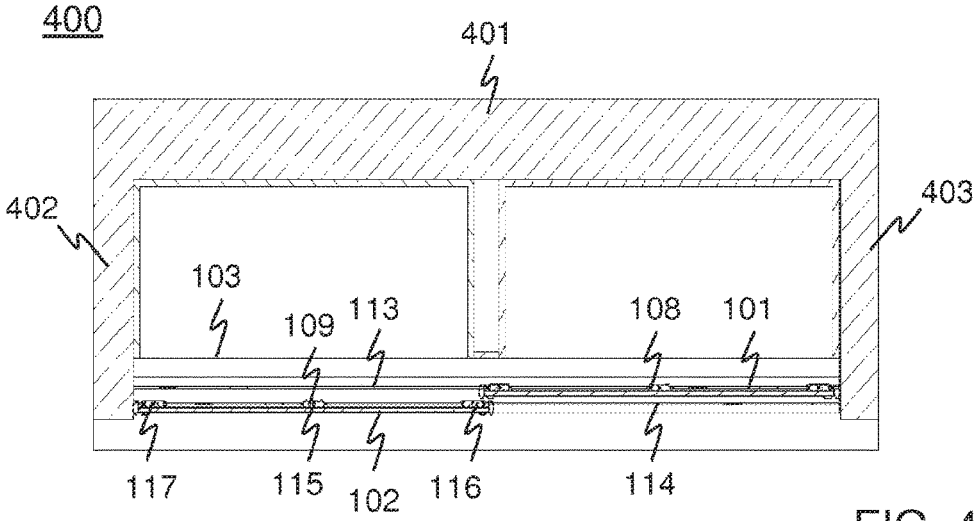
FIG. 4 is a diagrammatic representation of an application of the system illustrated on FIGS. 1 to 3 in a cupboard niche, showing a horizontal sectional view.
Figure 5:
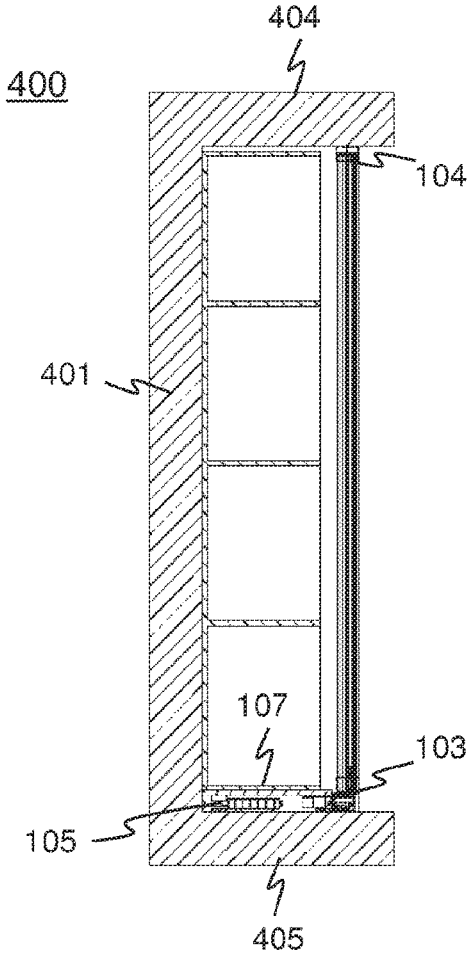
FIG. 5 is a diagrammatic representation of the application of the system illustrated on FIGS. 1 to 3 in the cupboard niche, showing a vertical sectional view.

FIGS. 4 and 5 are diagrammatic representations of an application of the system 100 illustrated on FIGS. 1 to 3 in a cupboard niche 400. FIG. 4 shows a horizontal sectional view of this application. FIG. 5 shows a vertical sectional view.

Various walls define the cupboard niche 400: a back wall 401, two side walls, i.e. a left side wall 402 and a right side wall 403, a wall 404 forming a ceiling, and a wall 405 forming a floor. These walls will be respectively designated below by the simple terms "back 401", "left side 402", "right side 403", "ceiling 404" and "floor 405" for reasons of convenience. The ceiling 404 may be a false ceiling, i.e. a relatively flexible wall hiding a rigid covering wall.

The bottom slide rail 103 is placed on the ground and can be attached thereto by many different means. The top slide rail 104 is attached to the ceiling. The two doors 101, 102 are held between these slide rails as already illustrated on FIGS. 2 and 3. The floor 107 extends from the bottom slide rail 103 to the back 401 and between the left side 402 and the right side 403.

The control unit 105 is housed underneath the floor 107, near the two motors 110, 111 illustrated on FIG. 1. These motors can also be installed underneath the floor 107. The control unit 105 can be connected to the mains using a socket. This socket is advantageously located underneath the floor 107, in the back 401, in the left side 402, or in the right side 403.

FIG. 4 shows that the bottom slide rail 103 extends between the left side 402 and the right side 403 of the cupboard niche 400. The same applies for the top slide rail 104, not shown on this figure. The two longitudinal slots 113, 114 in the top side of the bottom slide rail 103 are clearly visible on FIG. 4. The two rolling mechanisms of the first door 101 are held in the first longitudinal slot 113 of the bottom slide rail 103. The first connecting lug 108 is attached to the first door 101 by means of the attachment plate fitted to this door. The two rolling mechanisms 116, 117 of the second door 102 are held in the second longitudinal slot 114 of the bottom slide rail 103. The second connecting lug 109 is attached to the second door 102 by means of the attachment plate 115 fitted to this door.

FIGS. 4 and 5 show that the cupboard niche 400 is provided with interior fittings. These interior fittings comprise several panels: back panels and side panels. These panels define two cupboard sections: a left section and a right section as illustrated on FIG. 4. The interior fittings also comprise several shelves and a floor placed on the floor 107 of the system 100 for sliding the two doors 101, 102.

Figure 6:
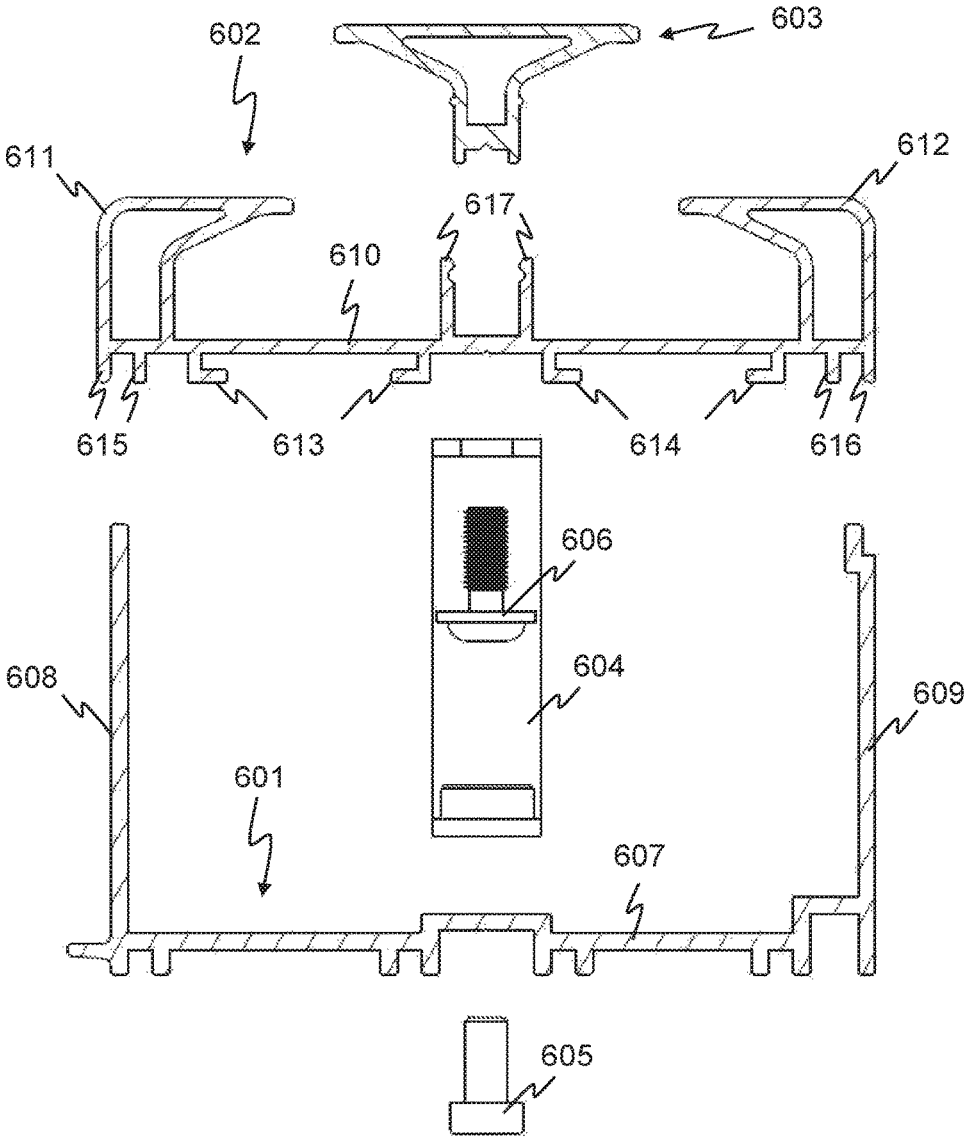
FIG. 6 is a diagrammatic representation of a set of elements to be assembled to form a unit of a bottom slide rail of the system, showing a sectional view.

FIG. 6 illustrates a set of elements to be assembled to form the unit 112 of the bottom slide rail 103 illustrated on FIGS. 1 to 5. This set of elements comprises several profiles: a lower profile 601, a main upper profile 602, and a complementary upper profile 603. The set of elements further comprises several assembly rods and several screws. FIG. 6 illustrates an assembly rod 604, which is similar to a brace, and two screws: an exterior assembly screw 605 and an interior assembly screw 606.

The lower profile 601 is U-shaped. In more detail, the lower profile 601 comprises a back wall 607 and a pair of side walls: a first side wall 608 and a second side wall 609. These side walls 608, 609 protrude from the back wall 607. The back wall 607 comprises several assembly holes which are not shown on FIG. 6. An assembly hole forms a passage for a threaded rod of an exterior assembly screw, such as the exterior assembly screw 605 illustrated on FIG. 6. This threaded rod can therefore engage in a bottom threaded section of an assembly rod, such as the assembly rod 604 illustrated on FIG. 6, in order to attach the lower profile 601 to the assembly rod.

The main upper profile 602 can cover the lower profile 601 as suggested on FIG. 6. The main upper profile 602 comprises a back wall 610 and a pair of edge segments 611, 612 protruding from the back wall 610: a first edge segment 611 and a second edge segment 612. In assembled state, the back wall 610 forms an inner wall of the unit 112 which is arranged parallel to the top side of the unit 112 visible on FIG. 1.

The back wall 610 of the main upper profile 602 forms a bearing surface for the casters of the two rolling mechanisms 116, 117 of the second door 102, described above with reference to FIG. 1. The same applies for the casters of the two rolling mechanisms of the first door 101, for which the back wall 610 also forms a bearing surface. The back wall 610 will therefore be designated the bearing wall 610 in the remainder of the document.

The bearing wall 610 comprises two pairs of suspension lugs: a first pair of suspension lugs 613 and a second pair of suspension lugs 614. The first pair of suspension lugs 613 is similar to a pair of slides that can accommodate an attachment lug of an object to be suspended from the bearing wall 610. The same applies for the second pair of suspension lugs 614.

The bearing wall 610 further comprises two pairs of lower assembly lips, a first pair of lower assembly lips 615 below the first edge segment 611, and a second pair of lower assembly lips 616 below the second edge segment 612. The first pair of lower assembly lips 615 defines a first longitudinal groove in which an upper part of the first side wall 608 of the lower profile 601 can engage. Similarly, the second pair of lower assembly lips 616 defines a second longitudinal groove in which an upper part of the second side wall 609 of the lower profile 601 can engage.

The bearing wall 610 comprises several assembly holes which are not shown on FIG. 6. An assembly hole forms a passage for a threaded rod of an interior assembly screw, such as the interior assembly screw 606 illustrated on FIG. 6. This type of assembly screw is located inside an assembly rod, such as the assembly rod 604 illustrated on FIG. 6. The inside forms a passage for the interior assembly screw 606. A threaded rod of the interior assembly screw 606 can thus engage in a threaded section of the main upper profile 602.

The bearing wall 610 comprises a pair of upper assembly lips 617. The pair of upper assembly lips 617 defines a longitudinal groove in which the complementary upper profile 603 can engage. The pair of upper assembly lips 617 and the complementary upper profile 603 can be arranged for assembly by clipping. This assembly can be a temporary assembly completed by screwing the interior assembly screws, such as the interior assembly screw 606 illustrated on FIG. 6. An arrangement for an assembly by clipping may comprise grooves formed in the upper assembly lips 617 and ribs complementary to the grooves, present on the complementary upper profile 603. FIG. 6 illustrates this type of arrangement.

The first edge segment 611 of the main upper profile 602 has a hollow interior. This hollow interior is defined by a set of walls: an outer side wall protruding from the bearing wall 610, an inner side wall protruding from the bearing wall 610, and a covering wall extending between the outer side wall and the inner side wall. The covering wall defines a part of the top side of the unit 112 illustrated on FIG. 1. The inner side wall has the shape of a half-vault. This relatively light structure is extremely rigid. The second edge segment 612 of the main upper profile 602 has a similar structure. The longitudinal edge segments 611, 612 are in fact identical except for their orientations, inverted relative to each other.

The complementary upper profile 603 also comprises a hollow interior defined by a set of walls: a base wall, a pair of side walls protruding from the base wall, and a covering wall extending between the pair of side walls. The covering wall defines a part of the top side of the unit 112 illustrated on FIG. 1. The side walls have the shape of a half-vault. The shape is in fact similar to that of the inner side walls of the longitudinal edge segments 611, 612. This structure offers the same advantage: the complementary upper profile 603 is relatively light but nevertheless extremely rigid.

Figure 7:
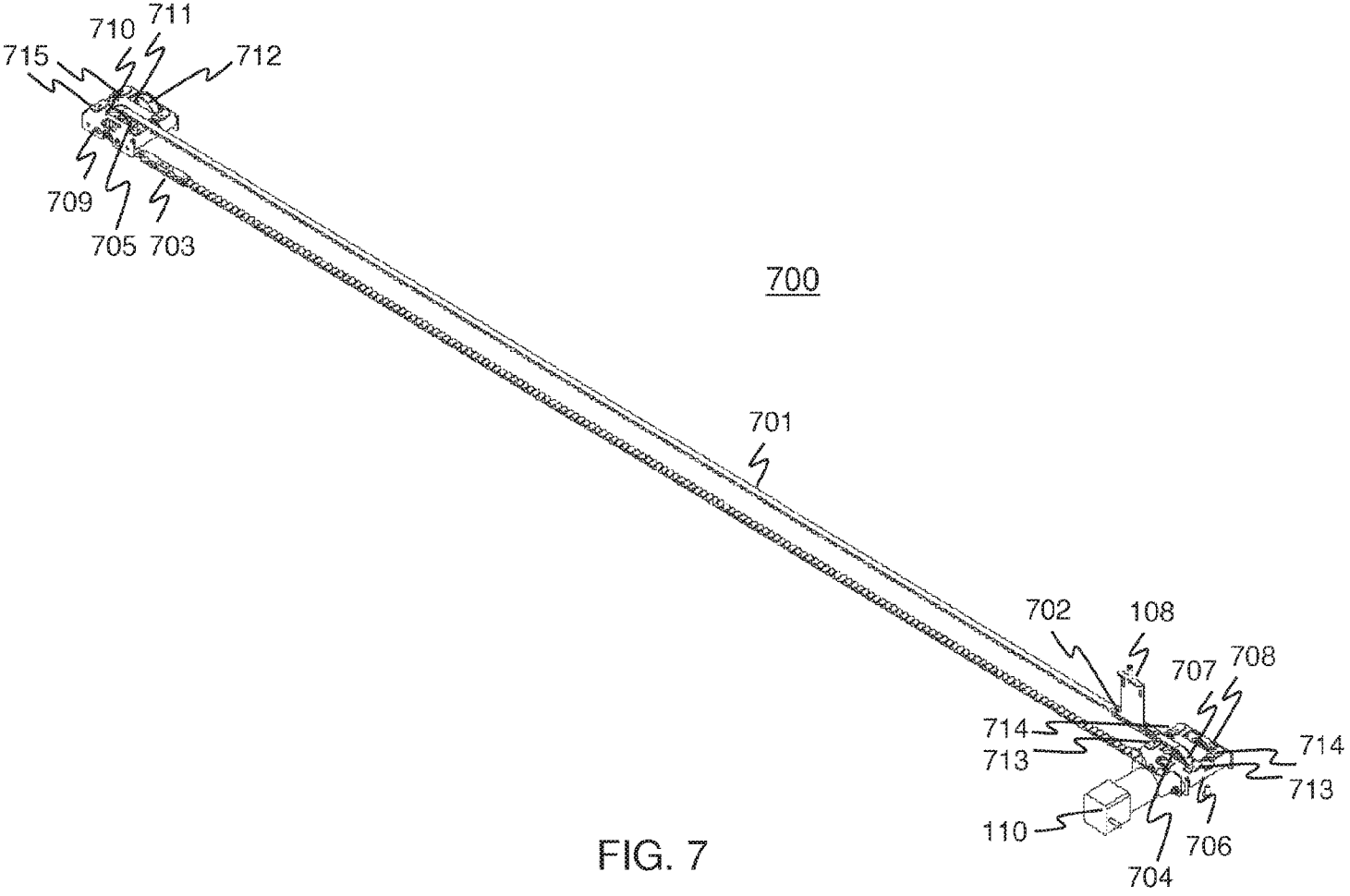
FIG. 7 is a diagrammatic representation of a transmission arrangement which can be housed in the unit of the bottom slide rail, showing a perspective view.

FIG. 7 is a diagrammatic representation of a transmission arrangement 700 which can be housed in the unit 112 of the bottom slide rail 103. FIG. 7 shows a diagrammatic perspective view of this arrangement. The transmission arrangement 700 may be part of the first drive device mentioned above. In this case, the transmission arrangement 700 is arranged between the first motor 110 and the first connecting lug 108.

These elements are also shown on FIG. 7. The transmission arrangement 700 converts a rotational movement of the drive shaft of the first motor 110 into a linear movement of the first connecting lug 108. Note that the second drive device which slides the second connecting lug 109 may comprise a transmission arrangement similar to that illustrated on FIG. 7.

The transmission arrangement 700 comprises a looped belt 701. This belt 701 consists of a continuous belt. A segment 702 of the belt 701 is connected to the first connecting lug 108. The looped belt 701 may consist of a belt having two ends with one connected to the other by a connecting device 703. This allows a relatively easy and customized assembly of the bottom slide rail 103.

The transmission arrangement 700 further comprises a pair of pulleys 704, 705 holding the looped belt 701: a motorized pulley 704 and an idler pulley 705. The motorized pulley 704 is connected to the first motor 110 which can turn this pulley in both directions of rotation. One direction of rotation creates a linear movement of the first connecting lug 108 towards the motorized pulley 704. The other direction of rotation creates a linear movement of the first connecting lug 108 towards the idler pulley 705.

The motorized pulley 704 is arranged in a first pulley bracket 706. The first pulley bracket 706 has two pulley locations: a first pulley location 707 and a second pulley location 708. The motorized pulley 704 is arranged in the first pulley location 707. The second pulley location 708 has no pulley. This location 708 comprises a ball bearing in which the drive shaft of the first motor 110 can engage.

The idler pulley 705 is arranged in a second pulley bracket 709. The second pulley bracket 709 also has two pulley locations: a first pulley location 710 and a second pulley location 711. The idler pulley 705 is arranged in the first pulley location 710. Another pulley 712 is arranged in the second pulley location 711. This other pulley 712 may form an idler pulley of the transmission arrangement which is part of the second drive device for sliding the second connecting lug 109 illustrated on FIG. 1.

The first pulley bracket 706 comprises attachment lugs 713, 714. A first pair of attachment lugs 713 can engage in the first pair of suspension lugs 613 present on the bearing wall 610 illustrated on FIG. 6. A second pair of attachment lugs 714 can engage in the second pair of suspension lugs 614. The first pulley bracket 706 can then be suspended from the bearing wall 610. The same remarks apply to the second pulley bracket 709, also provided with attachment lugs 715. These attachment lugs 715 engage in other suspension lugs provided on the bearing wall 610 in order to integrate the second pulley bracket 709 in the unit 112.

Figure 8:
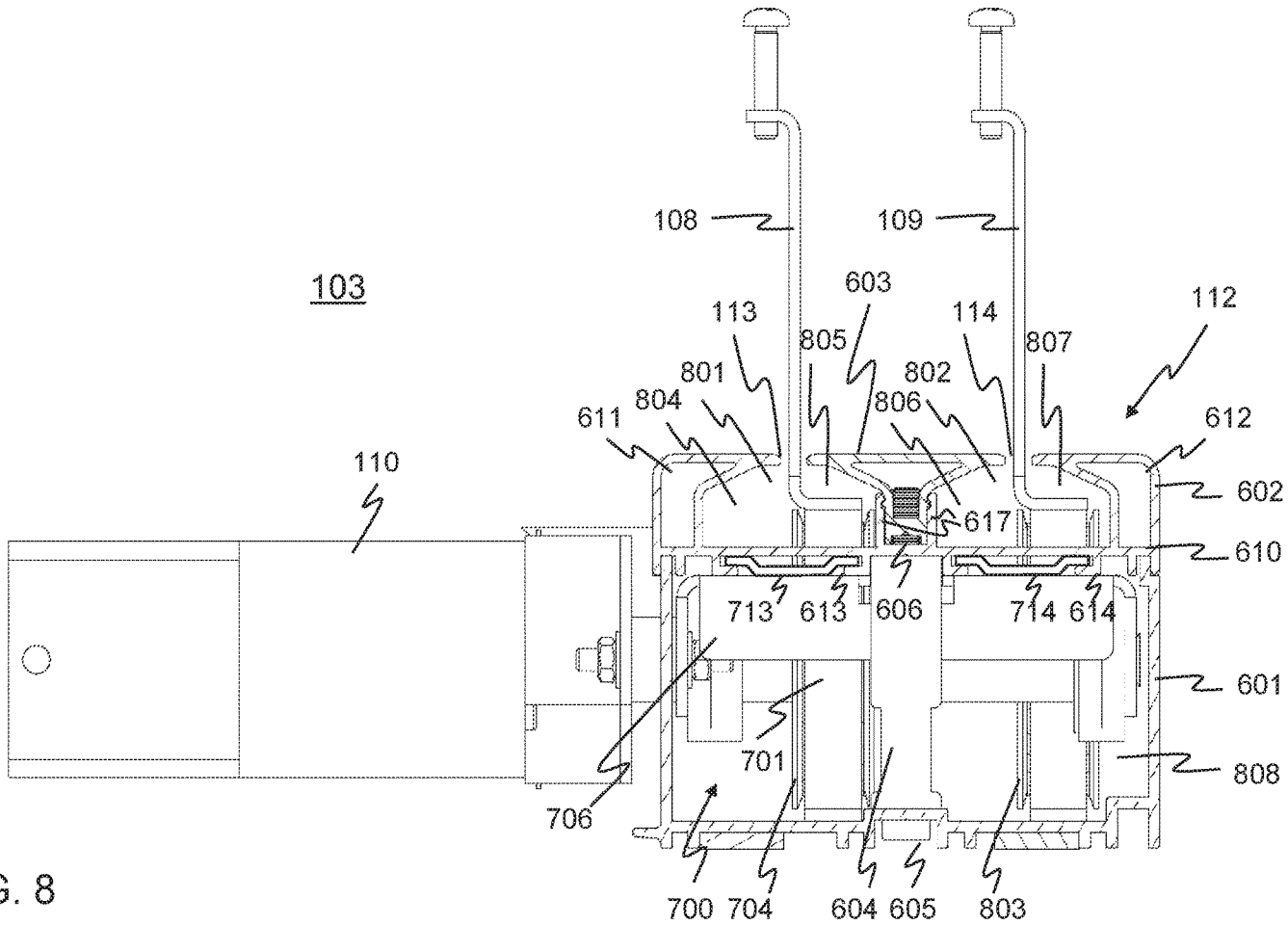
FIG. 8 is a diagrammatic representation of the bottom slide rail, showing a sectional view.

FIG. 8 is a diagrammatic representation of the bottom slide rail 103, showing a sectional view. The bottom slide rail 103 comprises the unit 112 formed by an assembly of the elements illustrated on FIG. 6. The transmission arrangement 700 illustrated on FIG. 7 is arranged in the unit 112. FIG. 8 also illustrates the first motor 110 of the bottom slide rail 103, as well as the first connecting lug 108 and the second connecting lug 109.

In more detail, FIG. 8 illustrates the main upper profile 602 of the unit 112 covering the lower profile 601. A lower part of the complementary upper profile 603 is held in the pair of upper assembly lips 617 illustrated on FIG. 6. The complementary upper profile 603 is rigidly attached to the main upper profile 602 by means of the interior assembly screw 606. This screw also attaches the assembly rod 604 to the main upper profile 602 and to the complementary upper profile 603. The lower profile 601 is rigidly attached to the assembly rod 604, and thus to the two other profiles 602, 603, by means of the exterior assembly screw 605.

FIG. 8 shows that the covering walls of the edge segments 611, 612 of the main upper profile 602, and the covering wall of the complementary upper profile 603, define the top side of the unit 112. There is a space between the covering wall of the first edge segment 611 and the covering wall of the complementary upper profile 603. This space forms the first longitudinal slot 113, in which the first connecting lug 108 can slide. Similarly, there is a space between the covering wall of the second edge segment 612 and the covering wall of the complementary upper profile 603. This space forms the second longitudinal slot 114, in which the second connecting lug 109 can slide.

FIG. 8 shows that the unit 112 comprises two slide channels: a first slide channel 801 and a second slide channel 802. The first slide channel 801 is located between the first edge segment 611 of the main upper profile 602 and the complementary upper profile 603. The first slide channel 801 leads to the first longitudinal slot 113. The second slide channel 802 is located between the second edge segment 612 of the main upper profile 602 and the complementary upper profile 603. The second slide channel 802 leads to the second longitudinal slot 114.

More precisely, the first slide channel 801 is defined by several walls of the unit 112. the inner side wall of the first edge segment 611 of the main upper profile 602, one of the two side walls of the complementary upper profile 603, and a part of the bearing wall 610. The second slide channel 802 is defined by several similar walls: the inner side wall of the second edge segment 612 of the main upper profile 602, the other of the two side walls of the complementary upper profile 603, and another part of the bearing wall 610. The two parts of the bearing wall 610 form respectively a back of the first slide channel 801 and a back of the second slide channel 802.

Referring also to FIG. 4, the casters of the two rolling mechanisms of the first door 101 can move in the first slide channel 801. Similarly, the two casters of the two rolling mechanisms 116, 117 of the second door 102 can move in the second slide channel 802. The same applies for the hooks of these rolling mechanisms which have a hooked tip held in the first slide channel 801 as regards the first door 101, and in the second slide channel 802 as regards the second door 102.

The first pulley bracket 706 is suspended from the bearing wall 610 in the unit 112. To do this, the first pair of attachment lugs 713 of the first pulley bracket 706 is held in the first pair of suspension lugs 613 present on the bearing wall 610. The second pair of attachment lugs 714 is held in the second pair of suspension lugs 614. The first pulley bracket 706 can be rigidly attached to the bearing wall 610, for example, by means of screws, or other rigid attachment means.

FIG. 8 illustrates the motorized pulley 704 also illustrated on FIG. 7, as well as a part of the looped belt 701 to which the first connecting lug 108 is connected. The drive shaft of the first motor 110, visible on FIG. 8, is rotatably connected to the motorized pulley 704. An opening is formed in the bearing wall 610 for the motorized pulley 704 to go through. Furthermore, openings are also formed in the bearing wall 610 for the idler pulley 705 and the other pulley 712, illustrated on FIG. 6, to go through.

FIG. 8 also illustrates another motorized pulley 803. This other motorized pulley 803 is part of the transmission arrangement of the second drive device for sliding the second connecting lug 109. The other motorized pulley 803 is therefore connected to the drive shaft of the second motor 111, which is visible on FIG. 1. The second motor 111 is not visible on FIG. 8, since it is located behind the first motor 110. An opening is also formed in the bearing wall 610 for the other motorized pulley 803 to go through.

The other motorized pulley 803 is arranged in a third pulley bracket, which is not visible on FIG. 8, since it is located behind the first pulley bracket 706. The third pulley bracket is similar to the first pulley bracket 706 illustrated on FIG. 7. In other words, the third pulley bracket also comprises a first pulley location and a second pulley location, as illustrated on FIG. 7. The other motorized pulley 803 is arranged in the second pulley location of the third pulley bracket, instead of being arranged in the first pulley location. The first pulley location may comprise a ball bearing. It is therefore an inversion of elements arranged in the two pulley locations compared with the first pulley bracket 706 illustrated on FIG. 7. The third pulley bracket can be attached to the bearing wall 610 in the same way as the first pulley bracket 706.

The other motorized pulley 803 can drive another looped belt, which is connected to the second connecting lug 109. For illustration purposes, a part of this other belt 701, partially surrounding the other motorized pulley 803, is not shown on FIG. 8. Thus, FIG. 8 illustrates the teeth of this other motorized pulley 803, which are also present on the motorized pulley 704, but not visible since hidden by the looped belt 701. The other looped belt can engage with the other pulley 712 of the second pulley bracket 709 illustrated on FIG. 7. In this case, this other pulley 712 therefore forms an idler pulley which is part of the transmission arrangement 700 of a second drive device for sliding the second connecting lug 109.

Note that the unit 112 is adapted to comprise two additional transmission arrangements for sliding two additional connecting lugs and therefore for sliding two additional doors. In fact, the first slide channel 801 comprises two slide tracks: a first slide track 804 corresponding to a left half of this channel 801, and a second slide track 805 corresponding to a right half of this channel 801. Similarly, the second slide channel 802 also comprises two slide tracks, which will be designated third slide track 806 and fourth slide track 807. Each of these slide tracks may comprise a belt sliding a connecting lug. FIG. 8 illustrates an embodiment where the second slide track 805 and the fourth slide track 807 are actually used. The first slide track 804 and the third slide track 806 remain available.

Some additions to the embodiment described above allow the system 100 to slide four doors. A fourth pulley bracket and a fifth pulley bracket, each comprising a motorized pulley, are arranged in the unit 112 near the first pulley bracket 706 illustrated on FIG. 7. These additional pulley brackets are similar to the first pulley bracket 706, but rotated through 180° with respect to this first pulley bracket 706. This inversion is due to the fact that the two pulley locations are respectively aligned with the first slide track 804 and the third slide track 806. A third motor is connected to the motorized pulley of the fourth pulley bracket, and a fourth motor is connected to the motorized pulley of the fifth pulley bracket.

Moreover, a sixth pulley bracket is arranged in the unit 112 near the second pulley bracket 709 illustrated on FIG. 7. This sixth pulley bracket is similar to the second pulley bracket 709, but also rotated through 180° with respect to this second pulley bracket 709. Once again, this inversion is due to the fact that the two pulley locations are respectively aligned with the first slide track 804 and the third slide track 806.

A looped belt crossing the first slide track 804 can therefore be held by the motorized pulley in the fourth pulley bracket and by an idler pulley in the sixth pulley bracket. Another looped belt crossing the third slide track 806 can therefore be held by the motorized pulley in the fifth pulley bracket and by another idler pulley in the sixth pulley bracket. A third connecting lug, which is vertically inverted relative to the first connecting lug 108, can be connected with the belt crossing the first slide track 804. Similarly, a fourth connecting lug, which is vertically inverted relative to the first connecting lug 108, can be connected with the belt crossing the third slide track 806.

FIG. 8 shows that the unit 112 comprises a bottom compartment 808. This bottom compartment is defined by the bearing wall 610 of the main upper profile 602 and the walls of the lower profile 601. A part of the transmission arrangement 700 is located in the bottom compartment 808. Referring also to FIG. 7, the connecting device 703 is located in the bottom compartment 808. The same applies for any other transmission arrangement arranged in the unit 112.

Figure 9:
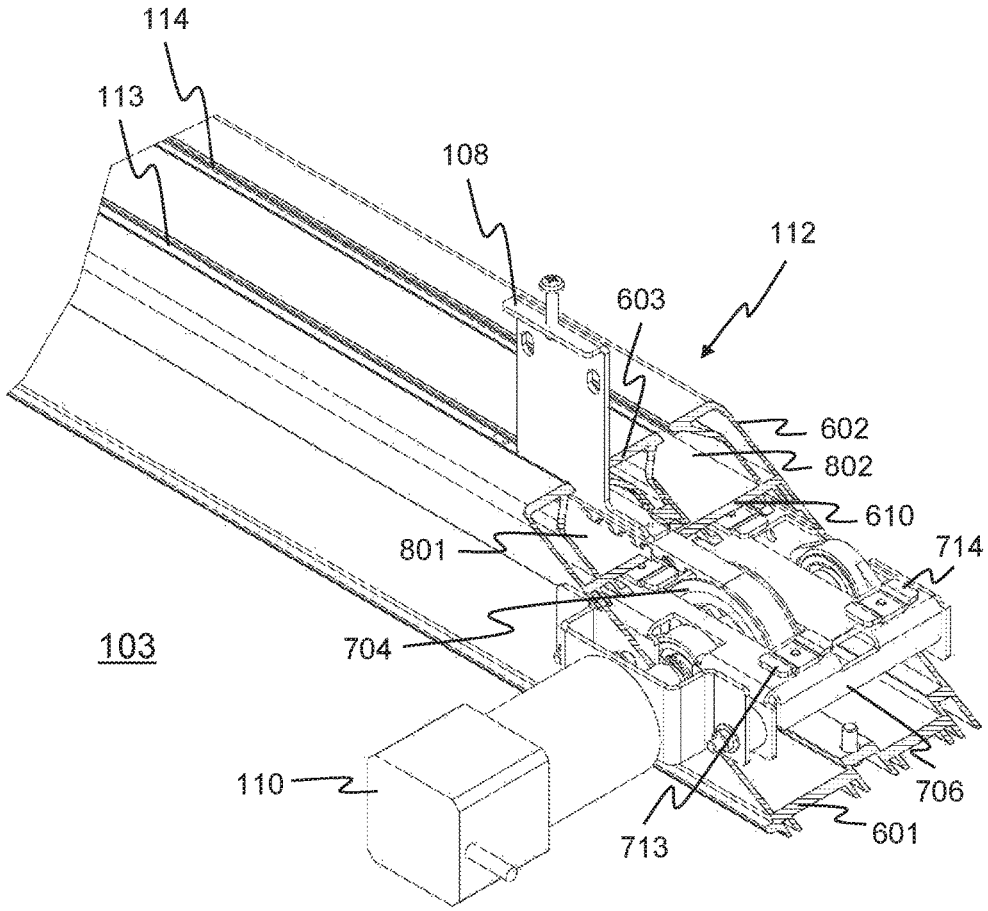
FIG. 9 is a diagrammatic representation of a section of the bottom slide rail, showing a partial sectional and perspective view.

FIG. 9 illustrates a section of the bottom slide rail 103 by a partial diagrammatic sectional and perspective view. The section illustrated on FIG. 9 is located near an end where the motorized pulley 704 is located. Several elements already shown on the previously described figures are also shown on FIG. 9. These elements include the first motor 110 and the unit 112 formed by the lower profile 601, the main upper profile 602, and the complementary upper profile 603. The first longitudinal slot 113 and the second longitudinal slot 114 as well as the first slide channel 801 and the second slide channel 802 are also visible on FIG. 9. The first pulley bracket 706 containing the motorized pulley 704, and the attachment lugs 713, 714 which are used to attach, at least temporarily, the first pulley bracket 706 to the bearing wall 610, are also visible.

Figure 10:
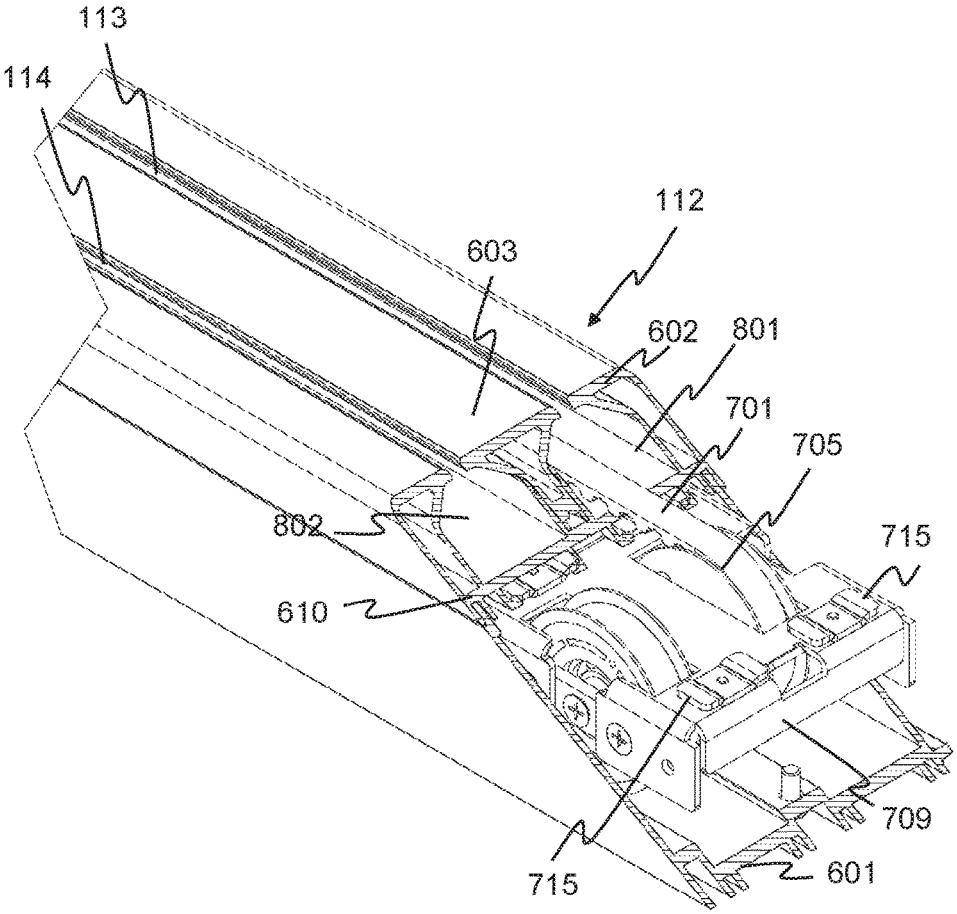
FIG. 10 is a diagrammatic representation of another section of the bottom slide rail, showing a partial sectional and perspective view.

FIG. 10 illustrates another section of the bottom slide rail 103 by a partial diagrammatic sectional and perspective view. The section illustrated on FIG. 10 is located near an end where the idler pulley 705 is located. FIG. 10 is an inverted representation with respect to that of FIG. 9. For simplification purposes, FIG. 10 only shows the looped belt 701 connected to the first connecting lug 108. The other looped belt, connected to the second connecting lug 109, is therefore not shown on FIG. 10.

Like FIG. 9, FIG. 10 illustrates several elements already shown on the previously described figures. These elements include the unit 112 formed by the lower profile 601, the main upper profile 602, and the complementary upper profile 603. The first longitudinal slot 113 and the second longitudinal slot 114 as well as the first slide channel 801 and the second slide channel 802 are also visible on FIG. 10. The second pulley bracket 709 containing the idler pulley 705, and the attachment lugs 715 which are used to attach, at least temporarily, the second pulley bracket 709 to the bearing wall 610, are also visible.

An example of a method for producing a cupboard using the system 100 illustrated on FIG. 1 is provided below. The method comprises several installation steps which will be described below, also with reference to FIG. 1. In this example, it is assumed that the cupboard is made in a cupboard niche like the cupboard niche 400 illustrated on FIGS. 4 and 5, having the same walls and the same width, height, and depth dimensions. It is also assumed that the following elements of the system 100 illustrated on FIG. 1 are adapted to the dimensions of the cupboard niche 400: the bottom slide rail 103, the top slide rail 104, the floor 107, and the two doors 101, 102. The control unit 105 and the remote control 106 can be standard.

In a first installation step, the control unit 105 is placed on the ground so that the control unit 105 is at least partially outside the cupboard niche 400. The control unit 105 is plugged into the mains.

In a second installation step, the heights of the feet 118 of the floor 107 are adjusted. The feet 118 are adjusted so that the top side of the floor 107 is located at the required level relative to the ground when the floor 107 is placed on the ground. The required level corresponds advantageously to the height of the unit 112 of the bottom slide rail 103. The floor 107 is then placed on the ground inside the cupboard niche 400. The control unit 105 is therefore partially located underneath the floor 107.

In a third installation step, the top slide rail 104 is attached to the ceiling. During this operation, it is important to check that the top slide rail 104 is properly positioned relative to the floor 107. For example, a rear side edge of the top slide rail 104 can be aligned with a front side edge of the floor 107. By properly positioning the top slide rail 104, the following two conditions will be met. A first condition is that the bottom slide rail 103 should be opposite the top slide rail 104. A second condition is that relatively little space should be left between the bottom slide rail 103 and the floor 107.

The ceiling can be a false ceiling, which is relatively flexible, as mentioned above. Typically, the top slide rail 104 can simply be attached to the false ceiling. In other words, it will not be necessary to provide relatively complex attachments passing through the false ceiling to attach the top slide rail 104 to a rigid wall, a "real" ceiling, located behind the false ceiling. This is due to the fact that the top slide rail 104 can be relatively light. In addition, this rail does not have to bear much weight; the weight of the two doors 101, 102 is supported by the bottom slide rail 103. The main function of the top slide rail 104 is to keep a door vertical, while allowing it to slide. This does not require any relatively rigid attachments.

In the third installation step, the interior fittings of the cupboard can be placed on the floor 107. FIGS. 4 and 5 show an example of such interior fittings. The cupboard to be produced can be equipped with its interior fittings before attaching the top slide rail 104 to the ceiling.

In a fourth installation step, the two motors 110, 111 of the bottom slide rail 103 are connected to the control unit 105 of which at least a part protrudes forwards out of the floor 107. This protruding part comprises terminals for electrically connecting the control unit 105 to the two motors 110, 111. Once connected to the two motors 110, 111, the control unit 105 is slid completely underneath the floor 107.

In a fifth installation step, the bottom slide rail 103 is positioned opposite the top slide rail 104. The two longitudinal slots 113, 114 of the bottom slide rail 103 are then aligned with the two running tracks of the top slide rail 104. This positioning is advantageously obtained by sliding the bottom slide rail 103 against the floor 107. In other words, the required positioning is obtained when the bottom slide rail 103 is in contact with the floor 107. The bottom slide rail 103 can then be locked in this position by attachment to the floor 107, or possibly to another wall next to the bottom slide rail 103.

In a sixth installation step, the two doors 101, 102 are placed between the bottom slide rail 103 and the top slide rail 104, so that the two doors 101, 102 are held between these slide rails. The verticality of the two doors 101, 102 can then be adjusted using the "Robotwin" type rolling mechanisms mentioned above. The first connecting lug 108 protruding from the unit 112 is then attached to the first door 101 by means of the attachment plate fitted on this door. This attachment may comprise height adjustment for aligning the attachment plate with the first connecting lug 108. Similarly, the second connecting lug 109 is attached to the second door 102 by means of the attachment plate 115 visible on FIG. 1.

In a seventh installation step, the system 100 is configured to perform the required sliding strokes. This generally involves defining two travel limits for the first door 101, and therefore for the first connecting lug 108, as well as two travel limits for the second door 102, and therefore for the second connecting lug 109. The control unit 105 stores these travel limits in order to apply them when controlling the bottom slide rail 103. The control unit 105 stops a sliding movement of the first door 101 when one of the two travel limits is reached. The same applies for the second door 102.

The travel limits can be defined by an automatic learning process. The control unit 105 can be programmed to detect the travel limits automatically. This detection can be carried out during first commissioning or after a mains power failure. It is advantageous to provide continuous detection which is carried out automatically, for example, during a door opening and closing cycle. To do this, the system 100 can comprise travel limit detectors connected to the control unit 105. This type of detector indicates to the control unit 105 that a travel limit has been reached. In response, the control unit 105 stops the motor concerned, and therefore the door having reached the travel limit. The two motors 110, 111 may comprise this type of detector.

Travel limits can also be defined manually. To do this, a user can use, for example, the remote control 106. The user causes a door to perform a sliding movement until this door reaches a position corresponding to a required travel limit. The user then presses one or more buttons on the remote control 106 so that the control unit 105 stores this position.

Once the installation process has been completed, the system 100 allows the cupboard to be opened and closed in an automated manner, in other words with little force. For example, a user can open a section of the cupboard blocked by the first door 101 by pressing a button on the remote control 106 causing the door to perform a sliding movement until this door reaches a predefined travel limit. Similarly, the user can open another section of the cupboard blocked by the second door 102.

Automated opening and closing can be carried out without the remote control 106. For example, the user can give a slight push to the first door 101 in a given direction. A detector detects this slight push, and the direction in which it is given. This detector, which can be integrated in the first motor 110, transmits this information to the control unit 105. In response, the control unit 105 causes the first door 101 to perform a sliding movement in the direction of the slight push given by the user to this door. This sliding movement continues until a predefined travel limit is reached. The same remarks apply to the second door 102. A person of reduced physical capacities, such as a disabled person, an elderly person or a child can therefore easily open and close the cupboard, even without a remote control.

The control unit 105 advantageously comprises one or more resistance detectors. A resistance detector detects an abnormal mechanical resistance during a sliding movement. In response to such detection, the control unit 105 stops the sliding movement, for example, by no longer actuating the motor driving this sliding movement. Such an arrangement avoids pinched fingers and other injuries that a sliding door could cause. The system 100 is therefore safer than a cupboard equipped with doors that open and close manually.

ADDITIONAL REMARKS

The detailed description which has just been made with reference to the drawings is only an illustration of some embodiments of the invention. The invention can be implemented in many different ways. To illustrate this, some alternatives are briefly indicated.

The invention can be advantageously applied in numerous embodiments comprising at least one sliding door. In principle, the invention can be applied in all types of arrangements comprising a space to be opened and closed, at least partially. A cupboard is an example of this type of arrangement. A shower unit is another example. The invention can therefore be applied to slide a shower wall, taking precautions to ensure sealing and electrical safety.

Moreover, an embodiment according to the invention may, in principle, comprise any number of doors. The detailed description describes an embodiment with two sliding doors. This does not exclude other embodiments with a single sliding door, or three sliding doors or, for example, four sliding doors.

The term "door" must be interpreted in the broad sense. This term encompasses any type of device that can block an opening providing access to a space, in particular a storage space. For example, a door may consist of a solid panel or a leaf provided with a filling panel which can be, for example, made of glass.

The above remarks show that the detailed description with reference to the figures, illustrates the invention rather than limiting it. The reference signs are not limiting. The verbs "comprise" and "include" do not exclude the presence of elements or steps other than those listed in the claims. The word "a" or "an" preceding an element or step does not exclude the presence of a plurality of such elements or such steps.

The invention claimed is:

1. A system for sliding a door, comprising:
- a bottom slide rail being adapted to be placed on a surface so that the door rests on the bottom slide rail, the bottom slide rail comprising:
  - an upper section comprising:
    - a top side defining a longitudinal slot;
    - an inner wall arranged parallel to, and separated from, the top side;
    - a slide channel defined between the top side, and the inner wall; and
  - a lower section defining a bottom compartment, wherein the lower section is disposed beneath the upper section such that the bottom compartment is beneath the inner wall;
- a connecting lug attachable to a bottom of the door, the connecting lug extending into the upper section through the longitudinal slot; and
- a drive device adapted to exert a driving force on the connecting lug, the drive device comprising:
  - a looped belt to which the connecting lug attaches;
  - a pair of pulleys around which the looped belt is wrapped, the pair of pulleys being fixed to the inner wall so that the looped belt is disposed in the slide channel and the bottom compartment; and
  - a motor having a drive shaft coupled to at least one pulley of the pair of pulleys, so that a rotational movement of the drive shaft of the motor causes a linear movement of the connecting lug.

2. The system according to claim 1, wherein the looped belt is toothed and the at least one pulley is toothed.

3. The system according to claim 1, wherein the looped belt comprises two ends with one of the ends connected to the other of the ends by a connecting device.

4. The system according to claim 3, wherein the connecting device is located in the bottom compartment.

5. The system according to claim 1, wherein the motor is arranged outside the bottom slide rail.

6. The system according to claim 1, wherein:
- the lower section is U-shaped;
- the upper section comprises:
  - a main upper section covering the lower section, the main upper section comprising the inner wall and a pair of edge segments protruding from the inner wall; and
  - an additional upper section attachable to the main upper section between the pair of edge segments.

7. The system according to claim 6, wherein at least one edge segment of the pair of edge segments has a hollow interior defined by:
- an outer side wall protruding from the inner wall;
- an inner side wall protruding from the inner wall; and
- a covering wall extending between the outer side wall and the inner side wall.

8. The system according to claim 7, wherein the inner side wall is curved.

9. The system according to claim 6, wherein the U-shaped lower section, the main upper section, and the additional upper section are attached to each other by screws.

10. The system according to claim 6, wherein the additional upper section comprises a hollow interior defined by:

a base wall;

a pair of side walls protruding from the base wall; and a covering wall extending between the pair of side walls of the additional upper section.

11. The system according to claim 10, wherein at least one side wall of the pair of side walls of the additional upper section is curved.

12. A cupboard comprising a system for sliding a door, the system comprising:

a bottom slide rail being adapted to be placed on a surface so that the door rests on the bottom slide rail, the bottom slide rail comprising:

an upper section comprising:

a top side defining a longitudinal slot;

an inner wall arranged parallel to, and separated from, the top side;

a slide channel defined between the top side, and the inner wall; and a lower section defining a bottom compartment, wherein the lower section is disposed beneath the upper section such that the bottom compartment is beneath the inner wall;

a connecting lug attachable to a bottom of the door, the connecting lug extending into the upper section through the longitudinal slot; and a drive device adapted to exert a driving force on the connecting lug, the drive device comprising:

a looped belt to which the connecting lug attaches;

a pair of pulleys around which the looped belt is wrapped, the pair of pulleys being fixed to the inner wall so that the looped belt is disposed in the slide channel and the bottom compartment; and a motor having a drive shaft coupled to at least one pulley of the pair of pulleys, so that a rotational movement of the drive shaft of the motor causes a linear movement of the connecting lug.

* * * * *